US006640585B2

(12) United States Patent
Oh et al.

(10) Patent No.: US 6,640,585 B2
(45) Date of Patent: Nov. 4, 2003

(54) REFRIGERATION CYCLE AND METHOD FOR DETERMINING CAPACITY OF RECEIVER THEREOF

(75) Inventors: Kwangheon Oh, Daejeon (KR); Sangok Lee, Daejeon (KR); Eunki Min, Daejeon (KR); Hwangjae Ahn, Daejeon (KR)

(73) Assignee: Halla Climate Control Corporation, Daejeon-si (KR)

( * ) Notice: Subject to any disclaimer, the term of this patent is extended or adjusted under 35 U.S.C. 154(b) by 0 days.

(21) Appl. No.: 10/323,297

(22) Filed: Dec. 19, 2002

(65) Prior Publication Data

US 2003/0110793 A1 Jun. 19, 2003

(30) Foreign Application Priority Data

Dec. 19, 2001 (KR) ..... 2001-81387

(51) Int. Cl.[7] ..... F25B 39/04
(52) U.S. Cl. ..... 62/509; 62/115; 62/149
(58) Field of Search ..... 62/509, 115, 149

(56) References Cited

U.S. PATENT DOCUMENTS 4,909,042 A * 3/1990 Proctor et al. ..... 62/149
5,813,249 A * 9/1998 Matsuo et al. ..... 62/509
5,927,102 A * 7/1999 Matsuo et al. ..... 62/509
6,000,465 A * 12/1999 Kawahara ..... 165/132
6,044,900 A * 4/2000 Kawahara ..... 165/110
6,330,810 B1 * 12/2001 Yamazaki et al. ..... 62/509
6,374,632 B1 * 4/2002 Nobuta et al. ..... 62/509
6,470,704 B2 * 10/2002 Shibata et al. ..... 62/509
6,477,858 B2 * 11/2002 Nobuta et al. ..... 62/509
6,516,628 B2 * 2/2003 Izawa et al. ..... 39/4

FOREIGN PATENT DOCUMENTS

JP 09-033139 2/1997

* cited by examiner

*Primary Examiner*—William C. Doerrler
*Assistant Examiner*—Mark Shulman
(74) *Attorney, Agent, or Firm*—Fulbright & Jaworski L.L.P.

(57) ABSTRACT

Disclosed is a refrigeration cycle and a method for determining a capacity of a receiver of a refrigeration cycle. According to the present invention, the capacity of the receiver can be determined according to the variations of the paths of the condenser, which provides an ability of fully coping with the variations of the cooling load. When the method for determining the capacity of the receiver according to the present invention is applied in the condenser integrated with the receiver, it is possible that an optimal capacity where no brazing failure occurs is obtained, which means the optimal capacity for the receiver can be easily determined.

9 Claims, 5 Drawing Sheets

REFRIGERATION CYCLE AND METHOD FOR DETERMINING CAPACITY OF RECEIVER THEREOF

BACKGROUND OF THE INVENTION

1. Field of the Invention

The present invention relates to a refrigeration cycle and a method for determining a capacity of a receiver of a refrigeration cycle.

2. Background of the Related Art

One of the conventional refrigeration cycles is disclosed in Japanese Patent Laid-open No. 9-33139 published on Feb. 7, 1997.

The prior art refrigeration cycle comprises a refrigerant compressor that is adapted to compress refrigerant, a refrigerant condenser that is provided with a plurality of condensing tube portion for condensing the refrigerant flowing from the refrigerant compressor and with a refrigerant combining portion for combining the refrigerants flowing from the plurality of condensing tube portion, a receiver that separates the refrigerant from the refrigerant combining portion of the refrigerant condenser into gaseous and liquid refrigerant to make only liquid refrigerant flow, a supercooling device that is provided with a refrigerant distribution portion for distributing the refrigerant flowing from the receiver and with a supercooling tube portion for supercooling the refrigerant distributed from the refrigerant distribution portion, a sight glass that is adapted to watch the state of the refrigerant flowing from the supercooling device, an expansion valve that is adapted to make the refrigerant flowing from the sight glass expanded, and a refrigerant evaporator that is adapted to make the refrigerant flowing from the expansion valve evaporated. If a required capacity of the fluid receiver is represented by VR, a sum of a capacity of the refrigerant condenser and a capacity of the supercooling device is represented by VCOND, a capacity of the refrigerant evaporator is represented by VEVA, a capacity of the supercooling tube portion is represented by VSC, and a sum of capacity of the refrigerant combining portion and a capacity of the refrigerant distribution portion is represented by Vh, relational expressions as described below;

$$V1=1.52\times10^{-3}\cdot VCOND(CC)+34.3\times10^{-3}\cdot VEVA(CC)$$

$$V2=170(CC)$$

$$V3=0.65\times(Vh+VSC)(CC)$$

$$VR\geqq0.8\times(V1+V2-V3)(CC)$$

$$VR\geqq0.8\times(V1+V2-V3)(CC) \text{ are satisfied.}$$

The above-mentioned refrigeration cycle is capable of providing a relatively small-sized receiver and preventing an effective heat exchanging area of a core of the refrigerant condenser from being reduced.

However, the components of the refrigeration cycle have different specifications according to the kind of vehicle and the variations of the cooling load is substantially irregular, such that it is difficult to measure a total capacity in the refrigeration cycle. Therefore, it is not easy that the above-described relational expressions shown in the conventional refrigeration cycle are actually applied.

Upon the process of brazing, besides, the refrigerant condenser integrated with the receiver is not heated evenly in a brazing furnace due to the variations of the heat capacity caused by the change of the capacity of the receiver, which causes a brazing failure that will result in an increase of the number of bad products.

To avoid the brazing failure, the receiver is designed to have a relatively small capacity, but this is not considered that the local temperature difference in the brazing furnace still exists. Moreover, a correlative relationship between the refrigerant condenser and the receiver is not considered at all, and as the amount of stocked refrigerant of the receiver is decreased, refrigerant supply is not carried out stably in accordance with the variations of the cooling load. This of course causes the efficiency of the refrigeration cycle to be greatly low.

SUMMARY OF THE INVENTION

Accordingly, the present invention is directed to a refrigeration cycle and a method for determining a capacity of a receiver of a refrigeration cycle that substantially obviates one or more problems due to limitations and disadvantages of the related art.

An object of the present invention is to provide a refrigeration cycle that is provided with a compressor, a condenser, a receiver, an expansion valve and an evaporator, wherein a correlative relationship between a capacity of the condenser and a capacity of the receiver is obtained, and with the relational expression, the capacity of the receiver can be easily obtained.

Another object of the present invention is to provide a method for determining a capacity of a receiver in a refrigeration cycle that has a compressor, a condenser, the receiver, an expansion valve and an evaporator, wherein the capacity of the receiver can be easily obtained by using a capacity of the condenser.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

According to an aspect of the present invention, there is provided a refrigeration cycle that has a compressor, a condenser, a receiver, an expansion valve and an evaporator, wherein if a capacity of the condenser is represented by CVT and a capacity of the receiver is represented by RV, a relational expression of $29.71\times\ln(CVT)+35\leqq RV\leqq41.103\times\ln(CVT)+74.3$ is satisfied.

According to another aspect of the present invention, there is provided a method for determining a capacity of a receiver in a refrigeration cycle that has a compressor, a condenser, a receiver, an expansion valve and an evaporator, wherein if a capacity of the condenser is represented by CVT and a capacity of the receiver is represented by RV, a relational expression of $29.71\times\ln(CVT)+35\leqq RV\leqq41.103\times\ln(CVT)+74.3$ is satisfied.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE PREFERRED EMBODIMENT

Reference will now be made in detail to the preferred embodiments of the present invention, examples of which are illustrated in the accompanying drawings.

Figure 1:
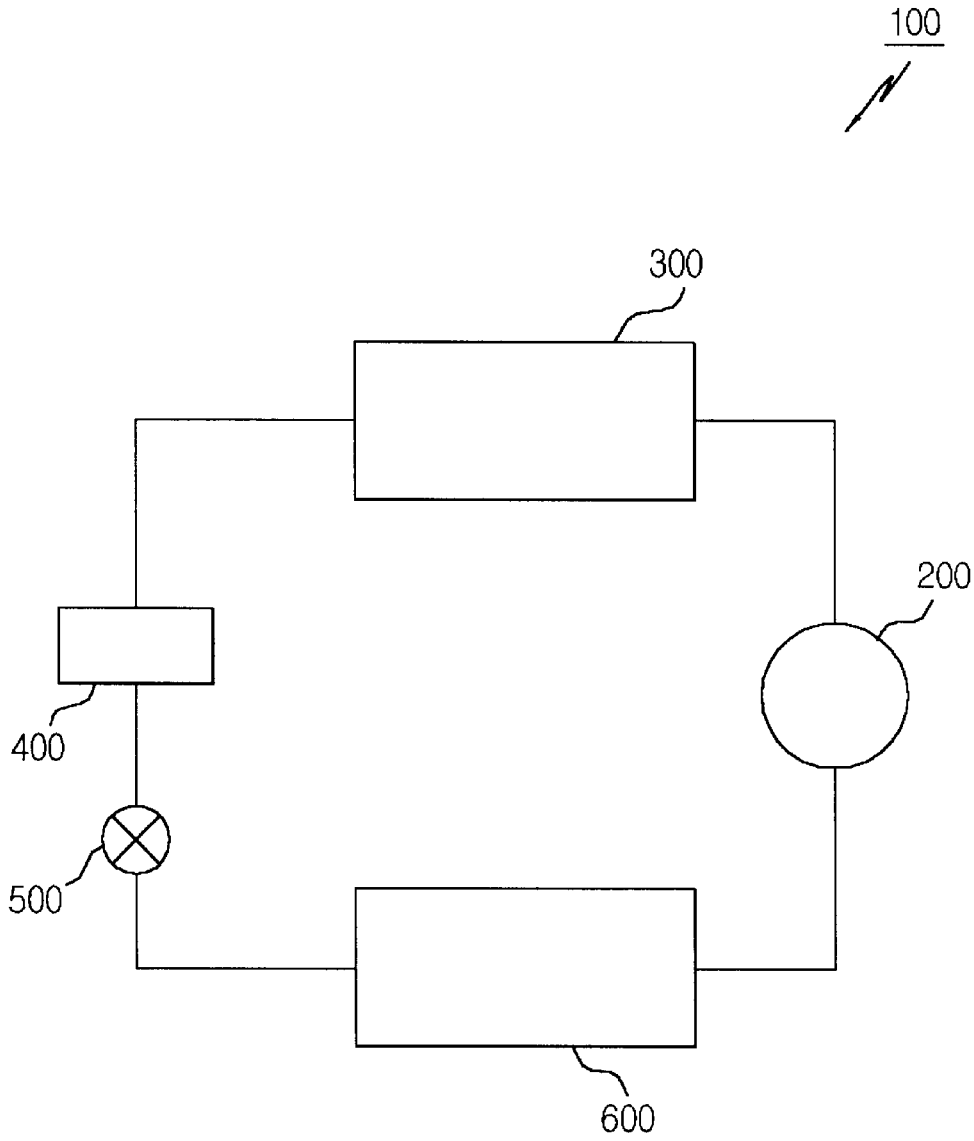
FIG. 1 is a block diagram showing a refrigeration cycle of an automotive air conditioning system according to the present invention.

As shown in FIG. 1, a refrigeration cycle 100 of an automobile air conditioning device according to the present invention includes a compressor 200, a condenser 300, a receiver 400, an expansion valve 500, and an evaporator 600.

In the refrigeration cycle 100, the refrigerant is compressed in the compressor 200 and delivered at high temperature and high pressure to the condenser 300.

After that, the refrigerant is condensed into a liquid phases and is passed through the receiver 400 and through the expansion valve 500. While passing, the refrigerant becomes at lower temperature and lower pressure and flows into the evaporator 600. Next, the refrigerant is thermally exchanged with around air, delivered to the compressor 200 and circulated in the refrigeration cycle.

Figure 2:
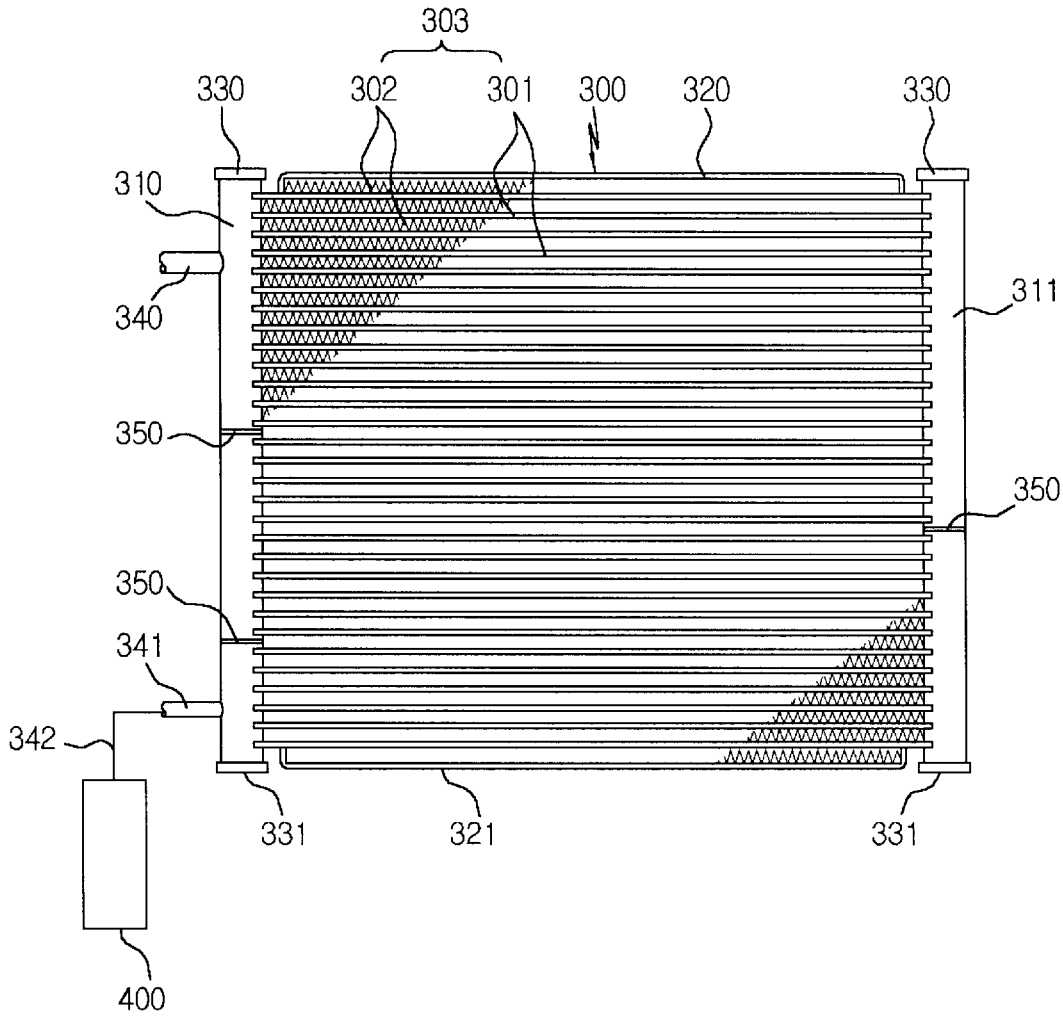
FIG. 2 is a front view showing an embodiment of the condenser according to the present invention.

The condenser 300 of the refrigeration cycle 100 comprises, as shown in FIG. 2, a core 303 that is provided with a plurality of tubes 301 that are arranged in parallel with one another and a plurality of fins 302 that are interposed alternately between adjacent tubes 301.

The plurality of tubes 301 are connected to a first header 310 at the one ends thereof and to a second header 311 at the other ends thereof.

The condenser 300 further comprises a pair of side plates 320 and 321 disposed at the outmost portion thereof.

The both ends of each the headers 310 and 311 are closed by caps 330 and 331.

The first header 310 is connected to an inlet pipe 340 at the upper portion thereof and to an outlet pipe 341 at the lower portion thereof. The outlet pipe 341 may be connected to the second header 311 differently from FIG. 2. Such location of the inlet/outlet pipe may be determined in relation with the number of paths formed.

Both the first and second headers 310 and 311 are provided with baffles 350 to define a plurality of refrigerant flow paths each defined by the plurality of tubes 301.

The refrigerant introduced into the condenser 300 provided with the above-mentioned construction is condensed into a liquid phase and delivered toward an external receiver 400 via a conduit 342 connected to the outlet pipe 341 and then, stored therein.

A certain capacity of refrigerant is maintained in the receiver 400 so as to deal with rapid variation of the amount of refrigerant circulated according to variations of the thermal load.

The receiver 400 is normally provided with a desiccant (which is not shown in FIG. 2) for removing water from refrigerant, in the inside thereof and with a lower cap (which is not also shown) for opening and closing the lower portion thereof.

In the conventional refrigerant system, the condenser 300 and the receiver 400 are separately provided.

Figure 3:
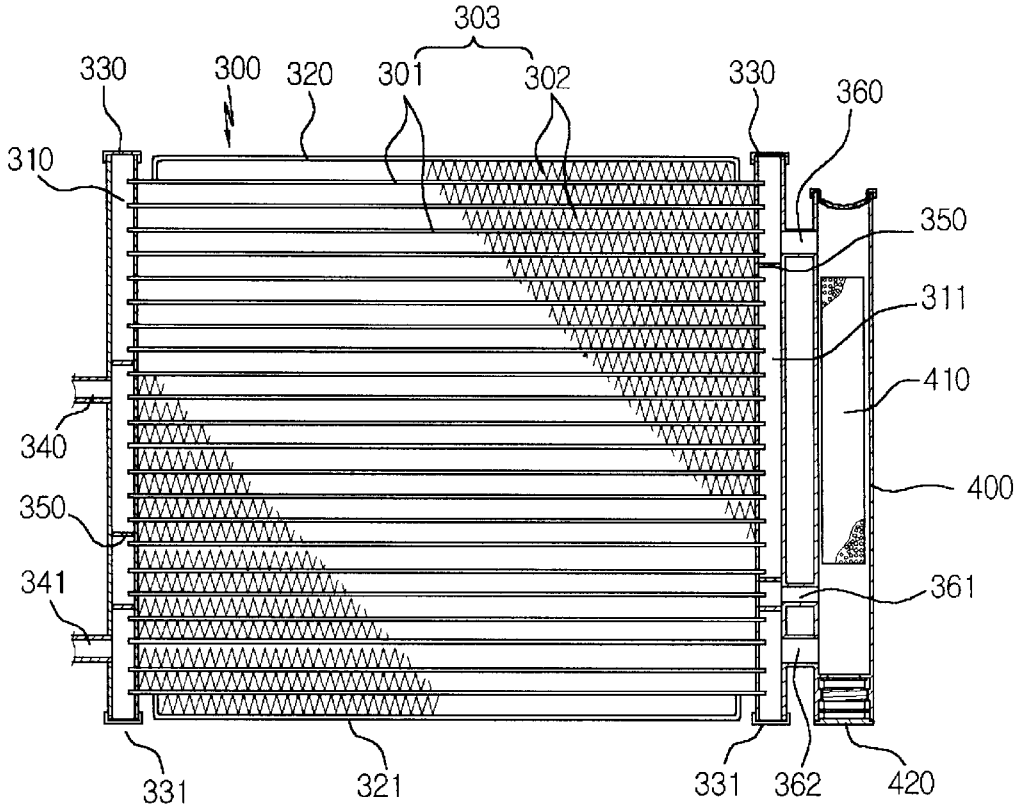
FIG. 3 is an entire cross-sectional view showing another embodiment of the condenser according to the present invention.

Next, another embodiment of the condenser to which the principles of the present invention are applied is shown. As shown in FIG. 3, the receiver 400 may be disposed on one of the first and second headers 310 and 311, on the drawing, the receiver 400 is disposed on the second header 311. While the gaseous refrigerant introduced into the condenser 300 through the inlet pipe 340 flows through the refrigerant paths in the condenser 300, a first separation of gaseous and liquid phases of the refrigerant occurs within the first and the second header 310, 311. Refrigerant is introduced into the receiver 400 via communication passageways 360, 361 and 362 disposed between the second header 311 and the receiver 400, wherein a second separation of gaseous and liquid phases of the refrigerant occurs within the receiver 400. In this embodiment, the condenser integrated with the receiver is employed such that the refrigerant discharged from the condenser 300 is maintained at the liquid phases.

In this case, the receiver 400 is further provided with a desiccant 410 for removing water from refrigerant, in the inside thereof and with a lower cap 420 for opening and closing the lower portion thereof.

Figure 4:
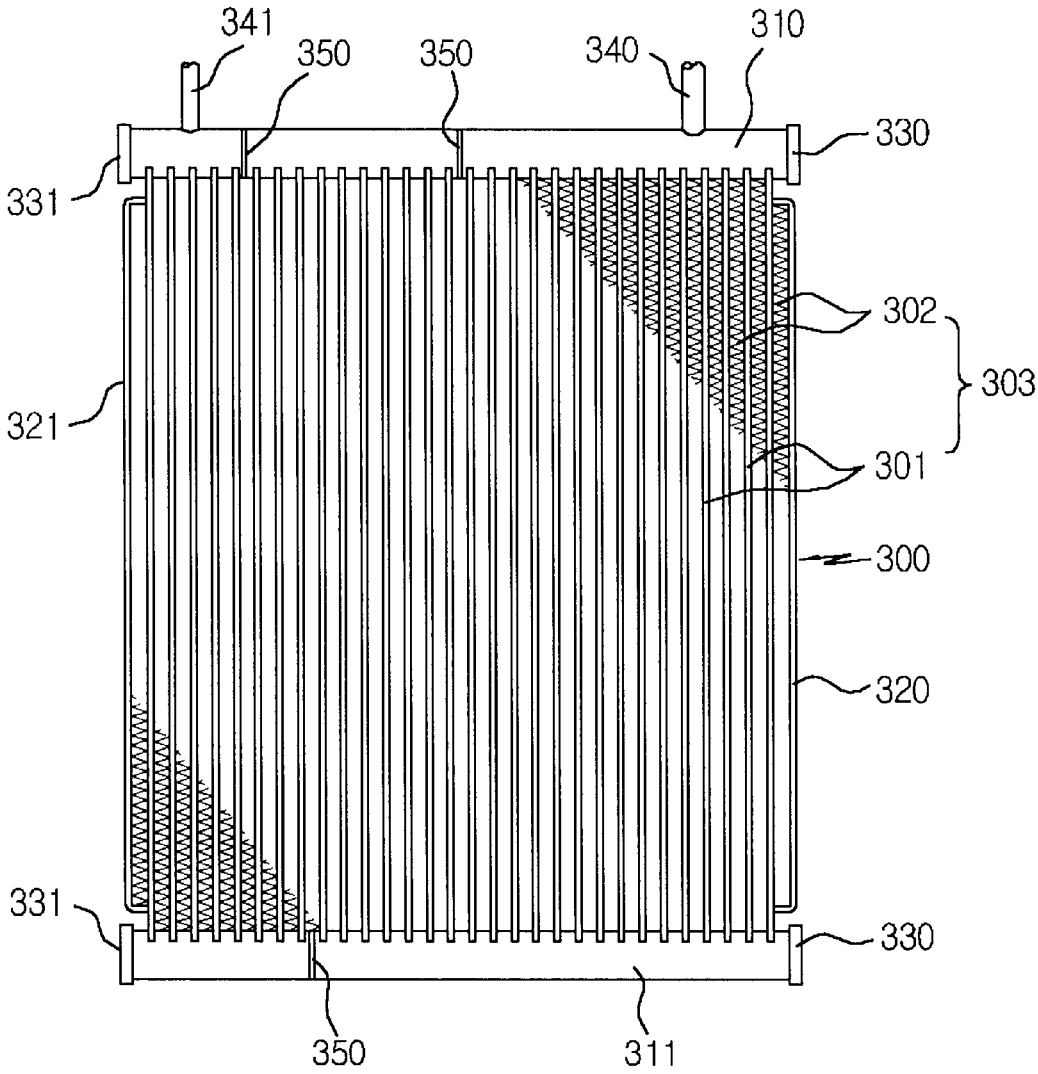
FIG. 4 is a front view showing still another embodiment of the condenser according to the present invention.

Moreover, still another embodiment of the condenser to which the principles of the present invention are applied is shown. As shown in FIG. 4, the first and second headers 310 and 311 are arranged upward and downward in parallel with each other and a plurality of tubes 301 are disposed vertically between the first and second headers 310 and 311 such that the refrigerant flows vertically to the receiver 400. This is called 'down flow type'.

As noted above, the present invention is directed to the refrigeration cycle that has a compressor, a condenser, a receiver, an expansion valve and an evaporator, wherein a correlative relationship between a capacity of the condenser and a capacity of the receiver is obtained, and with the relationship, the capacity of the receiver can be easily obtained.

In more detail, there is provided the refrigeration cycle that has the compressor 200, the condenser 300, the receiver 400, the expansion valve 500 and the evaporator 600 that are sequentially connected via refrigerant pipes so as to flow refrigerant therethrough, wherein if a capacity of the condenser 300 is represented by CVT and a capacity of the receiver 400 is represented by RV, a first relational expression as described below is satisfied.

[First Relational Expression]

$$29.71\times\ln(CVT)+35\leqq RV\leqq 41.103\times\ln(CVT)+74.3$$

The present inventors found that if the first relational expression is satisfied, the refrigeration cycle carries out refrigerant supply in more stable manner dealing with the variations of the cooling load, thereby completely preventing the efficiency of the refrigeration cycle from being substantially low. The optimal capacity RV of the receiver as obtained by experiments satisfies a second relational expression as described below.

[Second Relational Expression]

$$220\ cc \leqq RV \leqq 350\ cc$$

And, the present inventors found that in case where the receiver 400 is provided with the desiccant 410 and the lower cap 420, a capacity RIV of the internal space of the receiver 400 satisfies a third relational expression as described below.

[Third Relational Expression]

$$29.71 \times \ln(CVT) - 15 \leqq RIV \leqq 41.103 \times \ln(CVT) + 24.268$$

The present inventors found that if the third relational expression is satisfied, the refrigeration cycle carries out refrigerant supply in more stable manner dealing with the variations of the cooling load, thereby completely preventing the efficiency of the refrigeration cycle from being substantially low. The capacity RIV of the internal space of the receiver as obtained by experiments satisfies a fourth relational expression as described below.

[Fourth Relational Expression]

$$150\ cc \leqq RIV \leqq 250\ cc$$

According to the present invention, on the other hand, there is provided a method for determining a capacity of the receiver in the refrigeration cycle that has the compressor 200, the condenser 300, the receiver 400, the expansion valve 500 and the evaporator 600 that are sequentially connected via refrigerant pipes so as to flow refrigerant therethrough, wherein if a capacity of the condenser 300 is represented by CVT and a capacity of the receiver 400 is represented by RV, a fifth relational expression as described below is satisfied.

[Fifth Relational Expression]

$$29.71 \times \ln(CVT) + 35 \leqq RV \leqq 41.103 \times \ln(CVT) + 74.3$$

Moreover, if the fifth relational expression is satisfied, the capacity RV of the receiver as obtained by experiments satisfies a sixth relational expression as described below.

[Sixth Relational Expression]

$$220\ cc \leqq RV \leqq 350\ cc$$

Figure 5:
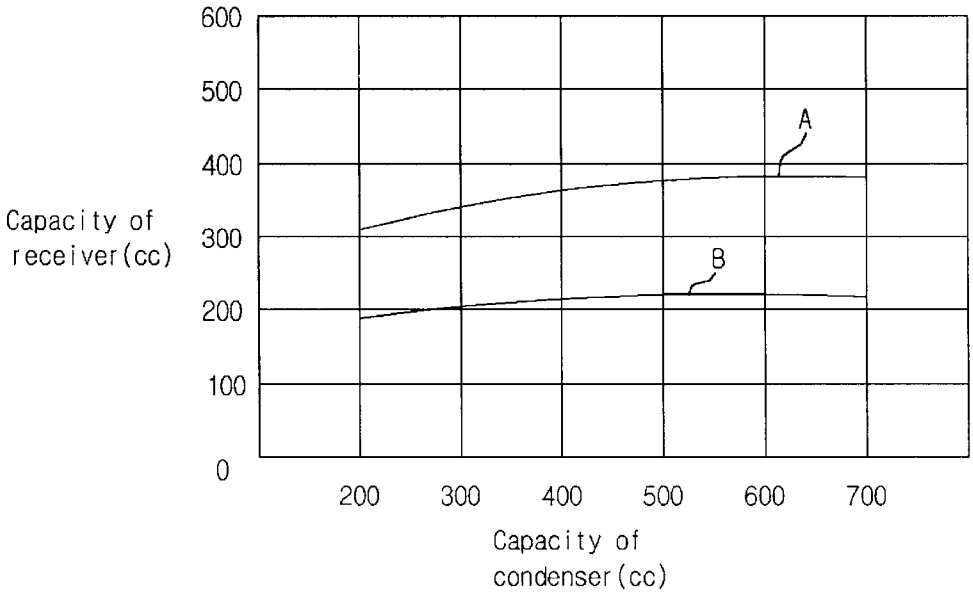
FIG. 5 is a graph showing the optimal ranges of a capacity values of the receiver with reference to the variations of a total capacity of the condenser.

FIG. 5 is a graph showing relation of the total capacity CVT of the condenser 300 and the capacity RV of the receiver 400.

A line A shows a variation of the maximum values of the capacity RV of the receiver 400 with reference to the variations of the total capacity CVT of the condenser 300, and to the contrary, a line B shows the variation of the minimum values of the capacity RV of the receiver 400 with reference to the variations of the total capacity CVT of the condenser 300.

That is to say, the capacity RV of the receiver 400 according to the present invention is determined in the range between the lines A and B with reference to the total capacity CVT of the condenser 300.

Figure 6:
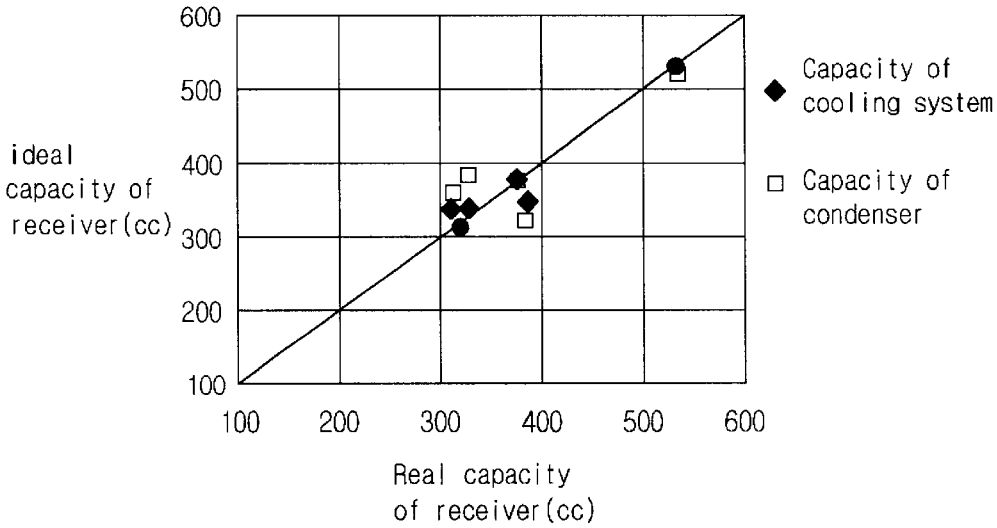
FIG. 6 is a graph showing the relationship between the results where the condenser integrated with the receiver to which the capacity determined according to the variations of the total capacity of the condenser is applied and that to which the capacity determined according to the variations of the total capacity of the cooling system is applied are respectively employed, and an ideal capacity of the receiver.

FIG. 6 is a graph showing the relationship between the results where the condenser integrated with the receiver to which the capacity RV determined according to the variations of the total capacity CVT of the condenser is applied and that to which the capacity determined according to the variations of the total capacity of the cooling system is applied are respectively employed, and an ideal capacity of the receiver.

As understood from the graph, the receiver 400, which has the capacity RV determined according to the variations of the total capacity CVT of the condenser, is in the range adjacent to the ideal capacity of the receiver, in the same manner as that having the capacity determined according to the total variations of the cooling system.

As clearly discussed above, therefore, the capacity RV of the receiver 400 can be determined simply according to the variations of the total capacity CVT of the condenser 300, not according to the variations of total capacity of the cooling system, which ensures that refrigerant supply is stably carried out according to the variations of the cooling load. Thereby no decrease the efficiency of the refrigeration cycle.

According to the present invention, the capacity RV of the receiver 400 can be determined according to the variations of the total capacity of the condenser, which provides an ability of fully coping with the variations of the cooling load.

When the method for determining the capacity of the receiver according to the present invention is applied in the condenser integrated with the receiver, it is possible that an optimal capacity where no brazing failure occurs is obtained, which means the optimal capacity for the receiver 400 can be easily determined.

When the condenser integrated with the receiver having the capacity determined by the method of the present invention is brazed, it can be understood that a probability for the generation of bad products due to the brazing failure can be reduced, which enables the productivity of the condenser to be enhanced and further allows the production cost to be substantially reduced.

The forgoing embodiments are merely exemplary and are not to be construed as limiting the present invention. The present teachings can be readily applied to other types of apparatuses. The description of the present invention is intended to be illustrative, and not to limit the scope of the claims. Many alternatives, modifications, and variations will be apparent to those skilled in the art.

What is claimed is:

1. A refrigeration cycle comprising a compressor, a condenser, a receiver, an expansion valve and an evaporator, wherein if a capacity of said condenser is represented by CVT and a capacity of said receiver is represented by RV, a relational expression of $29.71 \times \ln(CVT) + 35 \leqq RV \leqq 41.103 \times \ln(CVT) + 74.3$ is satisfied.

2. The refrigeration cycle according to claim 1, wherein said capacity RV of said receiver satisfies a relational expression of $220\ cc \leqq RV \leqq 350\ cc$.

3. The refrigeration cycle according to claim 1, wherein in case where said receiver is further provided with a desiccant and a lower cap, a capacity RIV of the internal space of said receiver satisfies a relational expression of $29.71 \times \ln(CVT) - 15 \leqq RIV \leqq 41.103 \times \ln(CVT) + 24.268$.

4. The refrigeration cycle according to claim 3, wherein said capacity RIV of the internal space of said receiver satisfies a relational expression of $150\ cc \leqq RIV \leqq 250\ cc$.

5. The refrigeration cycle according to claim 1, wherein said condenser comprises:

the first and second headers;

a plurality of tubes each connected to said first and second headers at opposite ends thereof;

a plurality of fins interposed between adjacent tubes; and inlet and outlet pipes connected to one of said first and second headers.

6. The refrigeration cycle according to claim 1, wherein said condenser comprises:

first and second headers disposed upward and downward in parallel with each other;

a plurality of tubes each connected to said first and second headers at opposite ends thereof;

a plurality of fins interposed between adjacent tubes; and

Inlet and outlet pipes connected to one of said first and second headers.

7. The refrigeration cycle according to claim 1, wherein said condenser is formed integrally with said receiver.

8. A method for determining a capacity of a receiver in a refrigeration cycle that has a compressor, a condenser, a receiver, an expansion valve and an evaporator, wherein if a capacity of said condenser is represented by CVT and a capacity of said receiver is represented by RV, a relational expression of $29.71 \times \ln(CVT)+35 \leqq RV \leqq 41.103 \times \ln(CVT)+74.3$ is satisfied.

9. The method according to claim 8, wherein said capacity RV of said receiver satisfies a relational expression of $220\ cc \leqq RV \leqq 350\ cc$.

* * * * *